US006889448B1

(12) United States Patent
Frew

(10) Patent No.: US 6,889,448 B1
(45) Date of Patent: May 10, 2005

(54) BOOT DRYING DEVICE, KIT AND METHOD

(76) Inventor: Roger S. Frew, 5300 Chamberlayne Ave., Delta, BC (CA) V4K 2J8

( * ) Notice: Subject to any disclaimer, the term of this patent is extended or adjusted under 35 U.S.C. 154(b) by 0 days.

(21) Appl. No.: 10/774,110

(22) Filed: Feb. 6, 2004

(51) Int. Cl.[7] ..... F26B 7/00
(52) U.S. Cl. ..... 34/417; 34/437; 34/442
(58) Field of Search ..... 34/417, 418, 437, 34/442, 90, 103, 104, 106, 107

(56) References Cited

U.S. PATENT DOCUMENTS

| | | | | |
|---|---|---|---|---|
| 2,076,735 A | | 4/1937 | Leindorf | |
| 2,614,337 A | | 10/1952 | Darbo | |
| 3,154,392 A | * | 10/1964 | Littman | 34/104 |
| 3,645,009 A | | 2/1972 | Ketchum | |
| 4,085,519 A | | 4/1978 | Masika | |
| 5,003,707 A | | 4/1991 | Chu | |
| 5,179,790 A | | 1/1993 | Poulos | |
| 5,222,308 A | * | 6/1993 | Barker et al. | 34/104 |
| 5,289,642 A | * | 3/1994 | Sloan | 34/104 |
| 5,720,108 A | * | 2/1998 | Rice | 34/104 |

FOREIGN PATENT DOCUMENTS

| | | | |
|---|---|---|---|
| DE | 1 755 116 | * | 3/1977 |
| FR | 2 276 012 | * | 2/1976 |

* cited by examiner

*Primary Examiner*—Stephen Gravini

(57) ABSTRACT

A boot dryer device, an associated kit for assembling the boot dryer device and a method of using same are disclosed for use in conveniently drying a pair of wet boots. The boot dryer device includes a T-junction conduit and an adaptor sleeve. The T-junction conduit has an input port and two outlet vent ports. The adaptor sleeve is operationally attached to the T-junction conduit so that it can efficiently transfer heated air from an electric air dryer into a pair of wet boots hung from the T-junction conduit. The kit includes the unconnected components of the device. The method includes the steps of enveloping, hanging, obtaining, plugging, pulling, removing, slipping, switching, turning, unplugging, and wrapping.

1 Claim, 3 Drawing Sheets

BOOT DRYING DEVICE, KIT AND METHOD

FIELD OF THE INVENTION

The present invention relates to drying devices, more particularly to a boot drying device, an associated kit for assembling the boot drying device and a method of using same.

BACKGROUND OF THE INVENTION

A wide variety of drying devices is currently available on the commercial market and an even larger number of these types of devices are known in the art of drying devices, for example, the shoe drying attachment disclosed by Leindorf in U.S. Pat. No. 2,076,735; the drier device for boots and the like disclosed by Darbo in U.S. Pat. No. 2,614,337; the glove- and boot-drying device disclosed by Ketchum in U.S. Pat. No. 3,645,009; the drying device disclosed by Masika in U.S. Pat. No. 4,085,519; the portable boot drying apparatus disclosed by Chu in U.S. Pat. No. 5,003,707; and the hot air boot dryer disclosed by Poulos in U.S. Pat. No. 5,179,790.

While all of the above-described devices fulfill their respective, particular objectives and requirements, the aforementioned patents do not describe a boot dryer device having a T-junction conduit operationally attached to an adaptor sleeve in which the T-junction conduit has an input port and two outlet vent ports. This combination of elements would specifically match the user's particular individual needs of making it possible to efficiently transfer heated air from an electric air dryer into a pair of wet boots hung from the T-junction conduit. The above-described patents make no provision for a boot dryer device having a T-junction conduit operationally attached to an adaptor sleeve in which the T-junction conduit has an input port and two outlet vent ports.

Therefore, a need exists for a new and improved boot dryer device having a T-junction conduit operationally attached to an adaptor sleeve in which the T-junction conduit has an input port and two outlet vent ports. In this respect, the boot dryer device according to the present invention substantially departs from the conventional concepts and designs of the prior art, and in doing so provides an apparatus primarily developed for the purpose of providing a convenient and efficient means for transferring heated air from an electric air dryer into a pair of wet boots hung from the T-junction conduit.

SUMMARY OF THE INVENTION

The present device, kit and method of using, according to the principles of the present invention, overcomes the shortcomings of the prior art by providing a novel and nonobvious boot dryer device, kit and method of using the same. The boot dryer device includes a T-junction conduit and an adaptor sleeve. The T-junction conduit has an input port and two outlet vent ports. The adaptor sleeve is operationally attached to the T-junction conduit so that it can efficiently transfer heated air from an electric air dryer into a pair of wet boots hung from the T-junction conduit. The kit includes the unconnected components of the device. The method includes the steps of enveloping, hanging, obtaining, plugging, pulling, removing, slipping, switching, turning, unplugging, and wrapping.

In view of the foregoing disadvantages inherent in the known type boot dryer devices now present in the prior art, the present invention provides an improved boot dryer device, which will be described subsequently in great detail, is to provide a new and improved boot dryer device which is not anticipated, rendered obvious, suggested, or even implied by the prior art, either alone or in any combination thereof.

To attain this, the present invention essentially comprises a T-junction conduit operationally attached to an adaptor sleeve. The T-junction conduit has an input port and two outlet vent ports. The adaptor sleeve is operationally attached to the T-junction conduit so that it can efficiently transfer heated air from an electric air dryer into a pair of wet boots hung from the T-junction conduit.

There has thus been outlined, rather broadly, the more important features of the invention in order that the detailed description thereof that follows may be better understood, and in order that the present contribution of the art may be better appreciated.

The invention may also include a first elastic band. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved boot dryer device that has all the advantages of the prior art boot dryer device and none of the disadvantages.

It is another object of the present invention to provide a new and improved boot dryer device that may be easily and efficiently manufactured and marketed.

An even further object of the present invention is to provide a new and improved boot dryer device that has a low cost of manufacture with regard to both materials and labor, and which accordingly is then susceptible of low prices of sale to the consuming public, thereby making such multipurpose storage unit and system economically available to the buying public.

Still another object of the present invention is to provide a new boot dryer device that provides in the apparatuses and methods of the prior art some of the advantages thererof, while simultaneously overcoming some of the disadvantages normally associated therewith.

Even still another object of the present invention is to provide a boot dryer device having a T-junction conduit operationally attached to an adaptor sleeve in which the T-junction conduit has an input port and two outlet vent ports. This combination of elements makes it possible to efficiently transfer heated air from an electric air dryer into a pair of wet boots hung from the T-junction conduit.

Still another object of the present invention is to provide a kit comprising the unassembled components of the device.

Lastly, it is an object of the present invention to provide a new and improved method of using comprising the steps of enveloping, hanging, obtaining, plugging, pulling, removing, slipping, switching, turning, unplugging, and wrapping.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and description matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
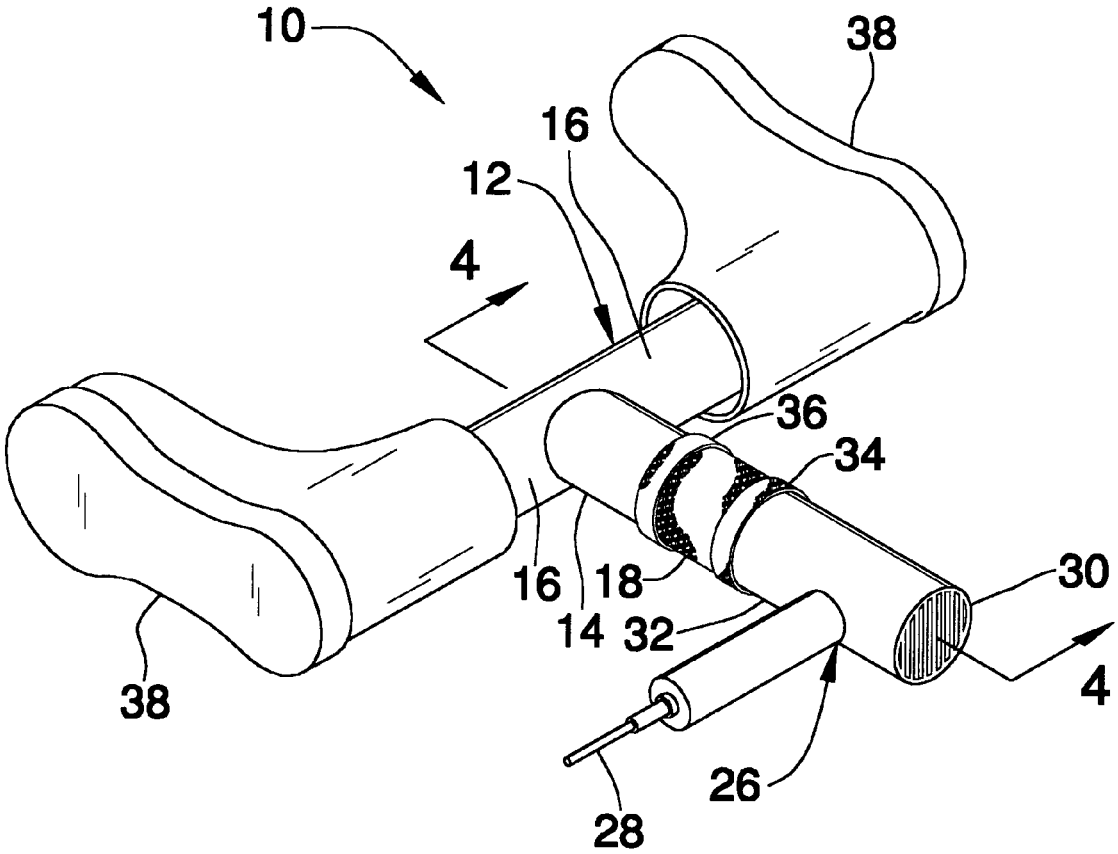
FIG. 1 is a perspective view of an preferred embodiment of the boot dryer device constructed in accordance with the principles of the present invention.
Figure 2:
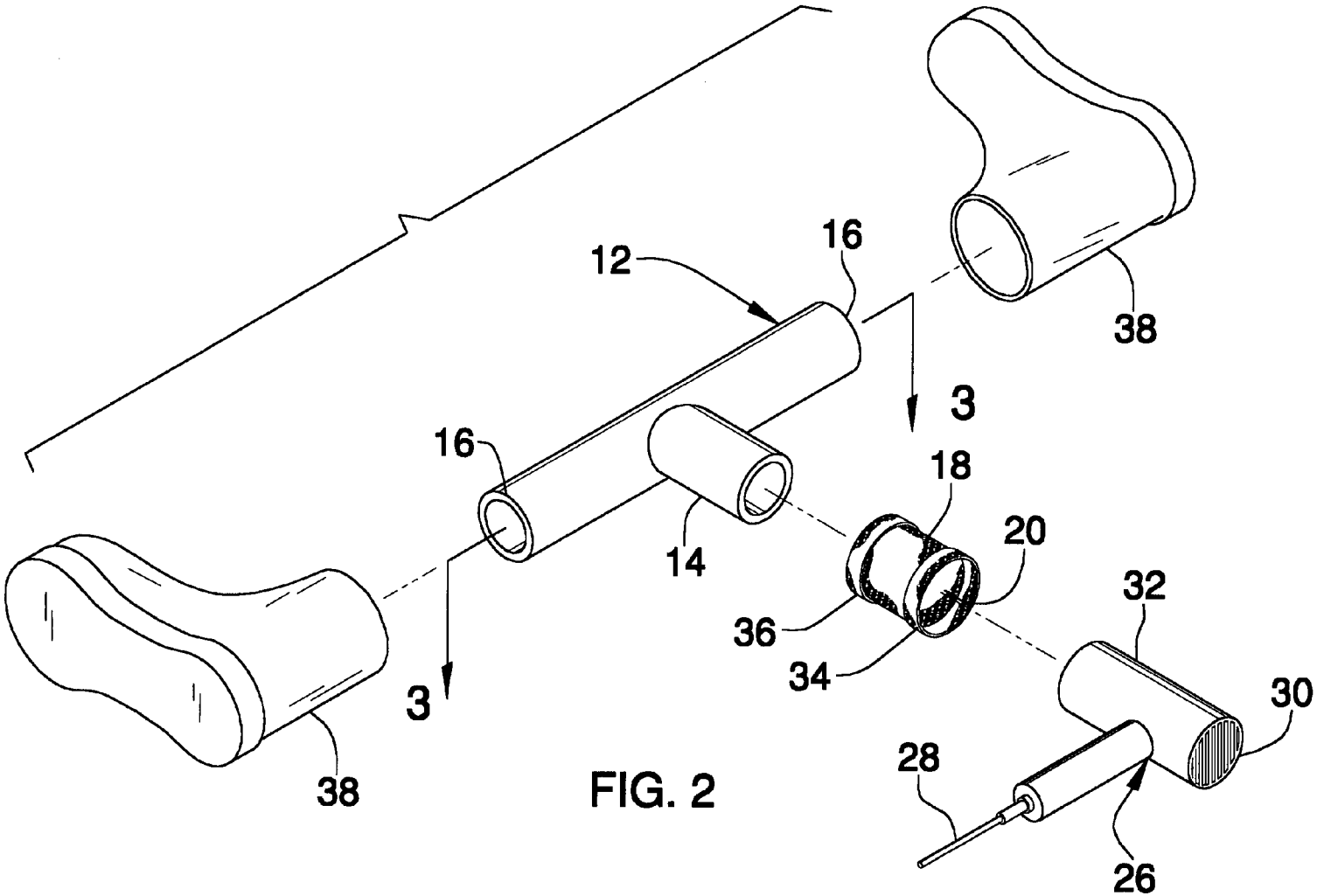
FIG. 2 is a perspective view of a preferred embodiment of the kit for the boot dryer device of the present invention.
Figure 3:
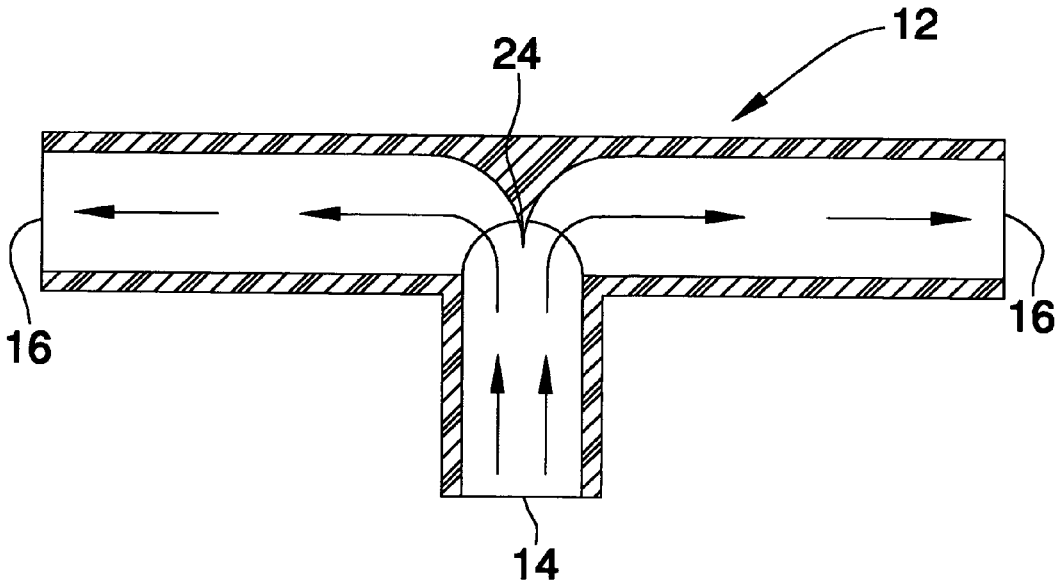
FIG. 3 is a cross sectional view of the T-junction conduit with the air divider wedge in a preferred embodiment of the boot dryer device of the present invention.
Figure 4:
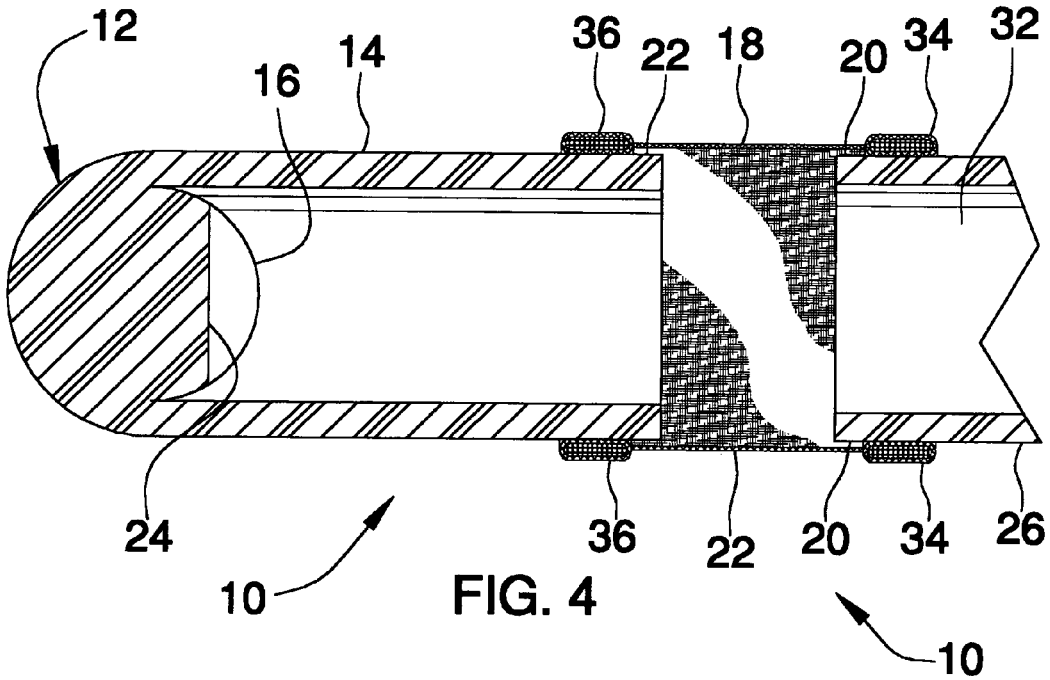
FIG. 4 is a cross sectional view of a preferred embodiment of the boot dryer device of the present invention.

Referring now to the drawings, and in particular FIG. 1 to 4 thereof, one preferred embodiment of the present invention is shown and generally designated by the reference numeral 10. One embodiment of a boot dryer device 10 comprises a T-junction conduit 12 and an adaptor sleeve 18. The T-junction conduit 12 has an input port 14 and two outlet vent ports 16, in which the input port 14 of the T-junction conduit 12 is in fluid communications with the two outlet vent ports 16. The adaptor sleeve 18 is attached to the T-junction conduit 12, in which the adaptor sleeve 18 has an entrance port 20 and an exit port 22, wherein the entrance port 20 of the adaptor sleeve 18 is in fluid communications with the exit port 22 of the adaptor sleeve 18, and wherein the exit port 22 of the adaptor sleeve 18 is in fluid communications with the input port 14 of the T-junction conduit 12.

An optional air divider wedge 24 may be added to the device 10 in which the optional air divider wedge 24 is attached internally to the T-junction conduit 12.

An optional electric air dryer 26 may be added to the device 10 in which the optional electric air dryer 26 is attached to the entrance port 20 of the adaptor sleeve 18, in which the electric air dryer 26 has an electric power cord 28, an air intake vent 30, and an air output vent 32, wherein the air intake vent 30 is in fluid communications with the air output vent 32, and wherein the air output vent 32 is in fluid communications with the entrance port 20 of the adaptor sleeve 18.

An optional first elastic band 34 may be added to the device 10 in which the optional first elastic band 34 is attached to the entrance port 20 of the adaptor sleeve 18 wherein the first elastic band 34 is connectable around to an air output vent 32 of an electric air dryer 26.

An optional second elastic band 36 may be added to the device 10 in which the optional second elastic band 36 is attached to the exit port 22 of the adaptor sleeve 18 wherein the second elastic band 36 is connected around the input port 14 of the T-junction conduit 12.

The T-junction conduit 12 may be made of any commercially available material such as plastic selected from the group consisting of rubber, neoprene, nylon, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The air divider wedge 24 may be made of any commercially available material such as plastic selected from the group consisting of rubber, neoprene, nylon, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The adaptor sleeve may be made of any commercially available material such as plastic selected from the group consisting of rubber, neoprene, nylon, polyvinyl chloride, polyester, polyethylene, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof. The adaptor sleeve 18 may also be made of fabric selected from the group consisting of cotton, wool, nylon, and silk.

One preferred embodiment of the kit for assembling a boot dryer device 10, the kit comprising: a T-junction conduit 12 has an input port 14 and two outlet vent ports 16, the input port 14 of the T-junction conduit 12 is in fluid communications with the two outlet vent ports 16; and an adaptor sleeve 18 attachable to the T-junction conduit 12, the adaptor sleeve 18 has an entrance port 20 and an exit port 22, the entrance port 20 of the adaptor sleeve 18 is in fluid communications with the exit port 22 of the adaptor sleeve 18, the exit port 22 of the adaptor sleeve 18 capable of being configured in fluid communications with the input port 14 of the T-junction conduit 12.

An optional air divider wedge 24 may be added to the kit in which the optional air divider wedge 24 is attached internally to the T-junction conduit 12.

An optional electric air dryer 26 may be added to the kit in which the optional electric air dryer 26 is attachable to the entrance port 20 of the adaptor sleeve 18, in which the electric air dryer 26 has an electric power cord 28, an air intake vent 30, and an air output vent 32, wherein the air intake vent 30 is in fluid communications with the air output vent 32, and wherein the air output vent 32 is capable of being configured in fluid communications with the entrance port 20 of the adaptor sleeve 18.

An optional first elastic band 34 may be added to the kit in which the optional first elastic band 34 is attached to the entrance port 20 of the adaptor sleeve 18 wherein the first elastic band 34 is connectable around an air output vent 32 of an electric air dryer 26.

An optional second elastic band 36 may be added to the kit in which the optional second elastic band 36 is attached to the exit port 22 of the adaptor sleeve 18 wherein the second elastic band 36 is connectable around the input port 14 of the T-junction conduit 12.

One preferred embodiment of a method of using a kit for assembling a boot dryer device 10 for air drying a pair of wet shoes, the method comprising the steps of enveloping, hanging, obtaining, plugging, pulling, removing, slipping, switching, turning, unplugging, and wrapping. The obtaining step comprises obtaining the kit comprising: a T-junction conduit 12 has an input port 14 and two outlet vent ports 16, the input port 14 of the T-junction conduit 12 in fluid communications with the two outlet vent ports 16; and an adaptor sleeve 18 attachable to the T-junction conduit 12, the adaptor sleeve 18 has an entrance port 20 and an exit port 22, the entrance port 20 of the adaptor sleeve 18 in fluid communications with the exit port 22 of the adaptor sleeve 18, the exit port 22 of the adaptor sleeve 18 capable of being configured in fluid communications with the input port 14 of the T-junction conduit 12; an air divider wedge 24 attached internally to the T-junction conduit 12; an electric air dryer 26 attachable to the entrance port 20 of the adaptor sleeve 18, the electric air dryer 26 has an electric power cord 28, an air intake vent 30, and an air output vent 32, the air intake vent 30 in fluid communications with the air output vent 32, the air output vent 32 capable of being configured in fluid communications with the entrance port 20 of the adaptor sleeve 18; a first elastic band 34 attached to the entrance port 20 of the adaptor sleeve 18 wherein the first elastic band 34 is connectable around an air output vent 32 of the electric air dryer 26; and a second elastic band 36 attached to the exit port 22 of the adaptor sleeve 18 wherein the second elastic band 36 is connectable around the input port 14 of the T-junction conduit 12. The wrapping step comprises wrapping the first elastic band 34 of the entrance port 20 of the adaptor sleeve 18 around the air output vent 32 of the electric air dryer 26, the wrapping step fluidly connecting together the entrance port 20 of the adaptor sleeve 18 to the air output vent 32 of the electric air dryer 26. The enveloping step comprises enveloping the second elastic band 36 of the exit port 22 of the adaptor sleeve 18 around the input port 14 of the T-junction conduit 12 wherein the enveloping step fluidly connecting together the exit port 22 of the adaptor sleeve 18 to the input port 14 of the T-junction conduit 12. The plugging step comprises plugging the electric power cord 28 of the electric air dryer 26 to an electric power socket. The switching step comprises switching on the electric air dryer 26. The hanging step comprises hanging a pair of wet boots 38 on the two outlet vent ports 16 of the T-junction conduit 12 while the electric air dryer 26 is switched on. The removing step comprises removing the hung boots 38 from the two outlet vent port of the T-junction conduit 12 when the hung boots 38 become dry. The turning step comprises turning off the electric air dryer 26. The unplugging step comprises unplugging the electric power cord 28 of the electric air dryer 26 from the electric power socket. The slipping step comprises slipping off the second elastic band 36 of the exit port 22 of the adaptor sleeve 18 from around the input port 14 of the T-junction conduit 12. The pulling step comprises pulling off the first elastic band 34 of the entrance port 20 of the adaptor sleeve 18 around the air output vent 32 of the electric air dryer 26.

As to the manner of usage and operation of the present invention, the same should be apparent from the above description. Accordingly, no further discussion relating to the manner of usage and operation will be provided.

While a preferred embodiment of the boot dryer device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Throughout this specification, unless the context requires otherwise, the word "comprise" or variations such as "comprises" or "comprising" or the term "includes" or variations, thereof, or the term "having" or variations, thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications which fall within its spirit and scope. The invention also includes all of the steps, features, compositions and compounds referred to or indicated in this specification, individually or collectively, and any and all combinations of any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of using a kit for assembling a boot dryer device for air drying a pair of wet shoes, the method comprising the steps of:

obtaining the kit comprising:

a T-junction conduit having an input port and two outlet vent ports, the input port of the T-junction conduit in fluid communications with the two outlet vent ports; and an adaptor sleeve attachable to the T-junction conduit, the adaptor sleeve having an entrance port and an exit port, the entrance port of the adaptor sleeve in fluid communications with the exit port of the adaptor sleeve, the exit port of the adaptor sleeve capable of being configured in fluid communications with the input port of the T-junction conduit;

an air divider wedge attached internally to the T-junction conduit;

an electric air dryer attachable to the entrance port of the adaptor sleeve, the electric air dryer having an electric power cord, an air intake vent, and an air output vent, the air intake vent in fluid communications with the air output vent, the air output vent capable of being configured in fluid communications with the entrance port of the adaptor sleeve;

a first elastic band attached to the entrance port of the adaptor sleeve wherein the first elastic band is connectable around an air output vent of the electric air dryer; and a second elastic band attached to the exit port of the adaptor sleeve wherein the second elastic band is connectable around the input port of the T-junction conduit;

wrapping the first elastic band of the entrance port of the adaptor sleeve around the air output vent of the electric air dryer, said wrapping step fluidly connecting together the entrance port of the adaptor sleeve to the air output vent of the electric air dryer;

enveloping the second elastic band of the exit port of the adaptor sleeve around the input port of the T-junction conduit wherein said enveloping step fluidly connecting together the exit port of the adaptor sleeve to the input port of the T-junction conduit;

plugging the electric power cord of the electric air dryer to an electric power socket;

switching on the electric air dryer;

hanging a pair of wet boots on the two outlet vent ports of the T-junction conduit while the electric air dryer is switched on;

removing the hung boots from the two outlet vent port of the T-junction conduit when the hung boots become dry;

turning off the electric air dryer;

unplugging the electric power cord of the electric air dryer from the electric power socket;

slipping off the second elastic band of the exit port of the adaptor sleeve from around the input port of the T-junction conduit; and pulling off the first elastic band of the entrance port of the adaptor sleeve around the air output vent of the electric air dryer.

* * * * *